US006276525B1

(12) United States Patent
Kobeluch et al.

(10) Patent No.: US 6,276,525 B1
(45) Date of Patent: Aug. 21, 2001

(54) PUZZLE HOLDER

(76) Inventors: Mary I. Kobeluch; Ronald R. Kobeluch, both of 269 Grove Ave., Des Plains, IL (US) 60016

( * ) Notice: Subject to any disclaimer, the term of this patent is extended or adjusted under 35 U.S.C. 154(b) by 0 days.

(21) Appl. No.: 09/610,388

(22) Filed: Jul. 5, 2000

(51) Int. Cl.[7] ..... B65D 85/20

(52) U.S. Cl. ..... 206/315.1; 206/499; 206/449; 273/157 R

(58) Field of Search ..... 206/315.1, 449, 206/454–456, 579, 425, 711, 499, 509, 511; 211/41.14, 41.17, 41.18; 273/153 R, 157 R, 157 A, 148 R, 287, 309; 150/106, 112, 119; 190/109, 110, 902; 40/700, 701

(56) References Cited

U.S. PATENT DOCUMENTS

| | | |
|---|---|---|
| 703,558 | 7/1902 | De Ford . |
| 1,941,558 | 1/1934 | Labbe . |
| 2,427,318 | 9/1947 | Warren . |
| 2,448,667 | 9/1948 | Gainsley . |
| 4,142,726 | 3/1979 | Anderson . |
| 4,486,018 | 12/1984 | Keller . |
| 5,538,248 | 7/1996 | Shillito . |
| 5,577,728 | 11/1996 | Kondo . |
| 5,624,118 | 4/1997 | Gottesman . |
| 5,651,547 | 7/1997 | Rannelli . |
| 5,895,049 | 4/1999 | Fingers . |

*Primary Examiner*—Shian Luong
(74) *Attorney, Agent, or Firm*—Don Moyer

(57) ABSTRACT

The puzzle holder comprises a frame, comprises a guide pair on the frame for receiving and supporting puzzles in a stack, comprises a stack pair on the frame for aiding stacking a second frame, interchangeable with the frame, on the frame, and comprises a handle connected to the frame for carrying the frame with puzzles edgewise.

5 Claims, 1 Drawing Sheet

PUZZLE HOLDER

BACKGROUND OF THE INVENTION

The product stores puzzles in stacks and carries puzzles edgewise.

Various devices for storing puzzles shown in prior art—for example in U.S. Pat. No. 703,558 by Ford, in U.S. Pat. No. 1,941,558 by Labbe, in U.S. Pat. No. 2,427,318 by Warren, in U.S. Pat. No. 2,448,667 by Gainsley, in U.S. Pat. No. 4,142,726 by Anderson, in U.S. Pat. No. 4,486,018 Keller, in U.S. Pat. No. 5,538,248 by Shillito, in U.S. Pat. No. 5,577,728 by Kondo, in U.S. Pat. No. 5,624,118 by Gottesman, in U.S. Pat. No. 5,651,547 by Rannelli, and in U.S. Pat. No. 5,895,049 by Fingers—do not suggest individually, nor in any combination, the puzzle holder shown here.

SUMMARY OF THE INVENTION

The puzzle holder comprises a frame having panels comprising a base panel, a left panel, and a right panel; comprises a guide pair on the frame for receiving and supporting a puzzle; comprises a stack pair on the frame for aiding stacking a second frame, interchangeable with the frame, on the frame; and comprises a handle connected to the frame distal one of the panels for carrying the puzzle edgewise.

DESCRIPTION OF THE PREFERRED EMBODIMENTS

Figure 1:
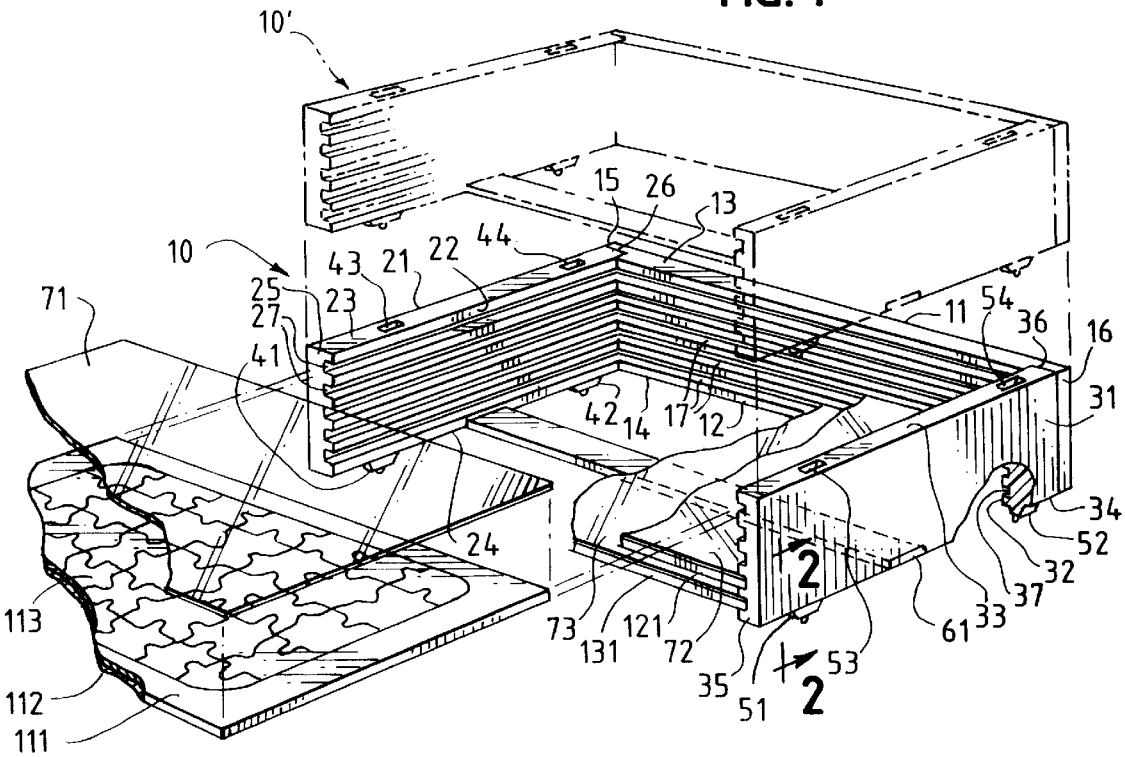
FIG. 1 depicts the puzzle holder storing puzzles.
Figure 3:
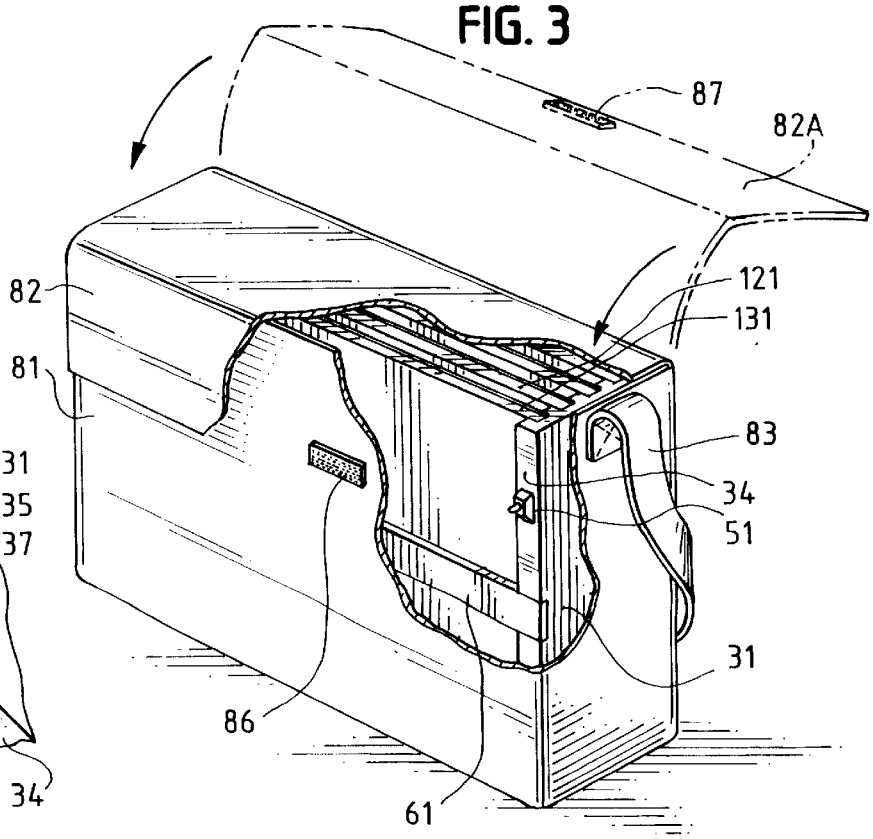
FIG. 3 depicts the puzzle holder carrying puzzles edgewise.
Figure 2:
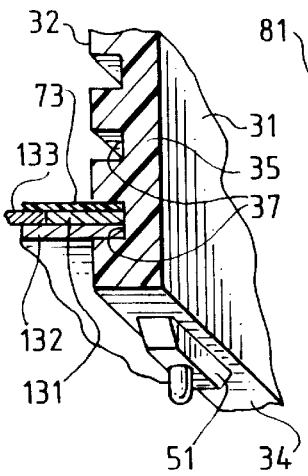
FIG. 2 depicts the view across line 2—2 in FIG. 1.

The puzzle holder 10 stores puzzles in stacks as depicted in FIG. 1 and carries puzzles edgewise as depicted in FIG. 3. The holder has a frame with panels comprising a base panel, a left panel, and a right panel.

The base panel has a base outside 11, a base inside 12, a base top long side 13, a base bottom long side 14, a base left short side 15, and a base right short side 16. The left panel has a left outside 21, a left inside 22, a left top long side 23, a left bottom long side 24, a left front short side 25, and a left back short side 26 connected to the base panel at the base left short side. The right panel has a right outside 31, a right inside 32, a right top long side 33, a right bottom long side 34, a right front short side 35, and a right back short side 36 connected to the base panel at the base right short side. An optional support member can be used to provide structural strength for example by connecting the right panel and the left panel as depicted 61.

There are guide pairs on the frame comprising left guides 27 extending from the left front short side along the left inside toward the left back short side and comprising right guides 37 extending from the right front short side along the right inside toward the right back short side. The right guides are guide aligned with the left guides in pairs so that puzzles can be received by and supported by guide pairs. Optional guides 17 in the back panel connect pairs of right and left guides.

While the guides are shown as grooves in the panels, the guides can take many forms—such as tracks, multiple pegs, and bristles all protruding from the frame—so long as guides can support puzzles in a stack.

The puzzles to be supported each have a bounding portion 111, 121, 131, have a base 112, 132, and have pieces 113, 133 within the bounding portion and resting on the base when in a stack. To keep pieces in place when the puzzle holder carries puzzles edgewise, cover sheets 71, 72, 73 are provided as a preferred, but optional, part of the product.

The holder can stack when the panel "bottom" sides 14, 24, 34 are supported on a surface. (Alternatively, the panel "top" sides 13, 23, 33 can be supported on the surface in place of the "bottom" sides.) The frame is also depicted displaced 10' in FIG. 1 to indicate this and to indicate stack alignment of stack pairs on the frame.

While only one stack pair stack aligned somewhere on the frame can be used, preferably there is a left panel front foot 41 and a left panel back foot 42 protruding from the left panel bottom side and a left panel front socket 43 and a left panel back socket 44 in the left panel top side. And, there is a right panel front foot 51 and a right panel back foot 52 protruding from the right panel bottom side and a right panel front socket 53 and a to right panel back socket 54 in the right panel top side.

The front feet are stack aligned with the front sockets and the back feet are stack aligned with the back sockets. A foot is stack aligned with a socket so that a second frame, interchangeable with the frame, could be stacked onto the frame with the foot fitting into the corresponding socket.

The feet can have various forms such as dowels, pins, tongues, plates, and the form depicted, with the sockets having the corresponding form.

The puzzle holder also comprises a handle which can be connected to the frame in various ways so that the puzzle holder carries puzzles edgewise, "edgewise" meaning that the handle is distal one of the three panels—for example distal the base panel as shown—so that a portion of the puzzle perimeter between the puzzle back and the puzzle bounding portion is supported on this distal panel.

Preferably, a handle 83 is connected to the frame by being attached to a bag 81 depicted in FIG. 3, the handle being distal one of the panels when the frame is contained by the bag and the bag is carried by the handle. The bag can have a closing flap 82 and 82A and fasteners such as the hook-and-loop fasteners 86, 87 indicated.

The puzzle holder can be fabricated from various materials such as wood and from various plastics by methods known in the art. The puzzle holder can also be fabricated by sealing plastic sheets with imbedded spacers by methods known in the art.

Descriptions, drawings, and referenced elements illustrating principles of the invention do not limit the invention as other equivalent elements, element configurations, and operations comprehended by principles of the invention will be obvious hereafter to persons skilled in the art.

What is claimed is:

1. A puzzle holder used in combination with a puzzle, the puzzle comprising:

a puzzle back;

a puzzle bounding portion; and puzzle pieces within the puzzle bounding portion;

the puzzle holder comprising:

a frame having panels comprising:

a base panel having a base inside, a base outside, a base top long side, a base bottom long side, a base left short side, and a base right short side;

a left panel having a left inside, a left outside, a left top long side, a left bottom long side, a left front short side, and a left back short side connected to the base panel at the base left short side; and a right panel having a right inside, a right outside, a right top long side, a right bottom long side, a right front short side, and a right back short side connected to the base panel at the base right short side;

a guide pair in the frame, the guide pair receiving and supporting the puzzle back, the guide pair comprising:

a left guide extending from the left front short side along the left inside toward the left back short side; and a right guide extending from the right front short side along the right inside toward the right back short side, the right guide being guide aligned with the left guide;

a stack pair on the frame, the stack pair comprising:

a stack foot on the frame; and a bag in use containing the frame with one of the panels entering the bag first, the bag comprising:

a front and a back connected by a bottom, a left side, and a right side leaving an open top;

a flap in use covering the top; and a handle on the bag, the handle being distal the panel entering first with the stack foot; and a handle connected to the frame distal one of the panels.

2. The product of claim 1 further comprising a cover sheet which in use is placed on a top portion of the bounding portion as the puzzle is received and supported by the guide pair.

3. The product of claim 1 further comprising a support member on the frame.

4. The product of claim 1 further comprising a base guide on the base inside, the base guide connecting the right guide and the left guide.

5. A puzzle holder used in combination with a puzzle, the puzzle comprising:

a puzzle back;

a puzzle bounding portion; and puzzle pieces within the puzzle bounding portion;

the puzzle holder comprising:

a frame having panels comprising:

a base panel having a base inside, a base outside, a base top long side, a base bottom long side, a base left short side, and a base right short side;

a left panel having a left inside, a left outside, a left top long side, a left bottom long side, a left front short side, and a left back short side connected to the base panel at the base left short side; and a right panel having a right inside, a right outside, a right top long side, a right bottom long side, a right front short side, and a right back short side connected to the base panel at the base right short side;

a guide pair in the frame, the guide pair receiving and supporting the puzzle back, the guide pair comprising:

a left guide extending from the left front short side along the left inside toward the left back short side; and a right guide extending from the right front short side along the right inside toward the right back short side, the right guide being guide aligned with the left guide;

a stack pair on the frame, the stack pair comprising:

a stack foot on the frame; and a stack socket on the frame, the stack socket being stack aligned with the stack foot;

a bag in use containing the frame with one of the panels entering the bag first, the bag comprising:

a front and a back connected by a bottom, a left side, and a right side leaving an open top;

a flap in use covering the top; and a handle on the bag, the handle being distal the panel entering first; and a cover sheet which in use is placed on a top portion of the bounding portion as the puzzle is received and supported by the guide pair;

a cover sheet which in use is placed on top of the bounding portion as the puzzle is received and supported by the guide pair.

* * * * *